US005864889A

United States Patent [19]

Suffern

[11] Patent Number: 5,864,889

[45] Date of Patent: Feb. 2, 1999

[54] COMBINATION GARMENT AND POCKET ASSEMBLY

[76] Inventor: Patricia V. Suffern, 8 Charlotte Mews, Middletown, N.Y. 10940

[21] Appl. No.: 819,552

[22] Filed: Mar. 17, 1997

[51] Int. Cl.[6] ..... A41D 27/20

[52] U.S. Cl. ..... 2/247; 2/53; 2/54; 2/56; 2/58

[58] Field of Search ..... 2/247, 248, 249, 2/250, 251, 53, 54, 55, 56, 57, 105, 106, 113, 114, 115, 69, 69.5; 450/105, 89

[56] References Cited

U.S. PATENT DOCUMENTS

| | | | |
|---|---|---|---|
| 519,487 | 5/1894 | Warner | 2/56 |
| 639,242 | 12/1899 | Jacks | 2/56 |
| 813,585 | 2/1906 | Reid | 2/54 |
| 1,059,811 | 4/1913 | Barrow | 2/54 |
| 1,078,443 | 11/1913 | Just | 2/53 |
| 2,074,153 | 3/1937 | Netsky | 2/54 |
| 3,508,279 | 4/1970 | Ayoub | 2/54 |
| 3,744,056 | 7/1973 | Bond | 2/54 |

FOREIGN PATENT DOCUMENTS

| | | | |
|---|---|---|---|
| 2649877 | 5/1978 | Germany | 2/54 |
| 2435 | 1/1910 | United Kingdom | 2/56 |
| 571350 | 8/1945 | United Kingdom | 2/53 |

*Primary Examiner*—Jeanette Chapman
*Attorney, Agent, or Firm*—Joseph L. Spiegel

[57] ABSTRACT

A pocket assembly for a garment includes a seamed bottom, the seams of which are adapted to be attached to the seams along the inner surface of the garment and a pocket member with overlapping flaps extending from the bottom for receipt of an article therein.

1 Claim, 2 Drawing Sheets

COMBINATION GARMENT AND POCKET ASSEMBLY

BACKGROUND OF INVENTION

1. Field of the Invention

This invention relates generally to a pocket assembly for a garment and, in particular, to a pocket assembly for the purpose of holding a removable object therein such as an absorbent shield or pad and to be secured to the inner surface of an existing garment in such manner as not to be visible at the outer surface of the garment.

2. Description of the Prior Art

Pocket assemblies for garments are well known in the prior art.

Jacks, U.S. Pat. No. 639,242 discloses a dress shield pocket that includes two flaps, one of which, an inner flap, is removably attachable to the body of a garment by buttons, whereby a dress shield may be placed between the garment and pocket and held in place.

The patent to Reid, U.S. Pat. No. 813,585 describes a garment with a pocket entirely independent of the garment so far as construction of the garment is concerned, with an opening for insertion and removal of a dress shield.

Harvey, U.S. Pat. No. 2,492,862 and Stapleton, U.S. Pat. No. 3,078,852 describe brassieres made equipped with pockets.

Madsen, U.S. Pat. No. 2,573,346 describes a dress shield including a holder with triangular pockets into which absorbent pads may be removably disposed. The shield is held in place by an elastic shield.

Morris, U.S. Pat. No. 2,886,820 describes a dress shield with insertable absorbent pads removably secured to a brassiere.

Ayoub, U.S. Pat. No. 3,508,279 relates to a ladies undergarment with underarm pockets that holds absorbent pads. Part of the garment is sewn into the shape of a pocket.

In Stanislaw, U.S. Pat. No. 5,255,392, a concealed pocket assembly is provided for incorporation into clothing. The assembly is incorporated into an article of clothing, at the time of manufacture of the article of clothing.

The patent to Lee, U.S. Pat. No. 5,496,205, discloses a brassiere with concealed closable pockets. The lower edge of the pockets are secured to reinforced seams within the brassiere and concealed between an intermediate padded lining to which the pocket is also attached and a rear fabric outer lining. The Lee pocket is to conceal small personal valuables within the brassiere and must be incorporated into the design before beginning construction of the brassiere.

The prior art problems as typified by the prior art cited above, but overcome by this invention, include: visibility of the pocket assembly on the external surface of the garment; separation or separability from the supporting garment; specific to only one type garment; and, necessity to incorporate the pocket assembly into the garment when initially made.

SUMMARY OF INVENTION

An object of the invention is a pocket assembly for a garment.

Another object is such an assembly which can be applied to an already completed garment.

Still another object is such an assembly, the attachment of which to an already completed garment is not visible on the outer surface of the garment.

A still further object is that such an assembly is attachable to both mens and womens clothing.

The objects of the invention are accomplished in accordance with the teachings of the present invention, one illustrative embodiment of which comprises a pocket assembly for a garment including a seamed bottom, the seams of which are adapted to be attached to the seams along the inner surface of the garment and a pocket member with overlapping flaps extending from the bottom for receipt of an article therein.

BRIEF DESCRIPTION OF THE DRAWING

Other objects, features and advantages of the invention will be apparent from the following detailed description and accompanying drawing, wherein.

DETAILED DESCRIPTION

ELEMENTS OF THE INVENTION

10—the garment

16—front panel of the garment

17—back panel of the garment

18—sleeve portion

14—first seam joining the body portion to the sleeve portion

20—second seam of sleeve portion

19—third seam of body portion joining front and back panels together

15—combination of seam 19 and 20 (fourth seam)

11—pocket assembly

21—fifth seam of the bottom of the pocket assembly

22—sixth seam of the bottom of the pocket assembly

23—first top piece of the pocket assembly

24—second top piece of the pocket assembly

30—top portion of the pocket assembly

Figure 1:
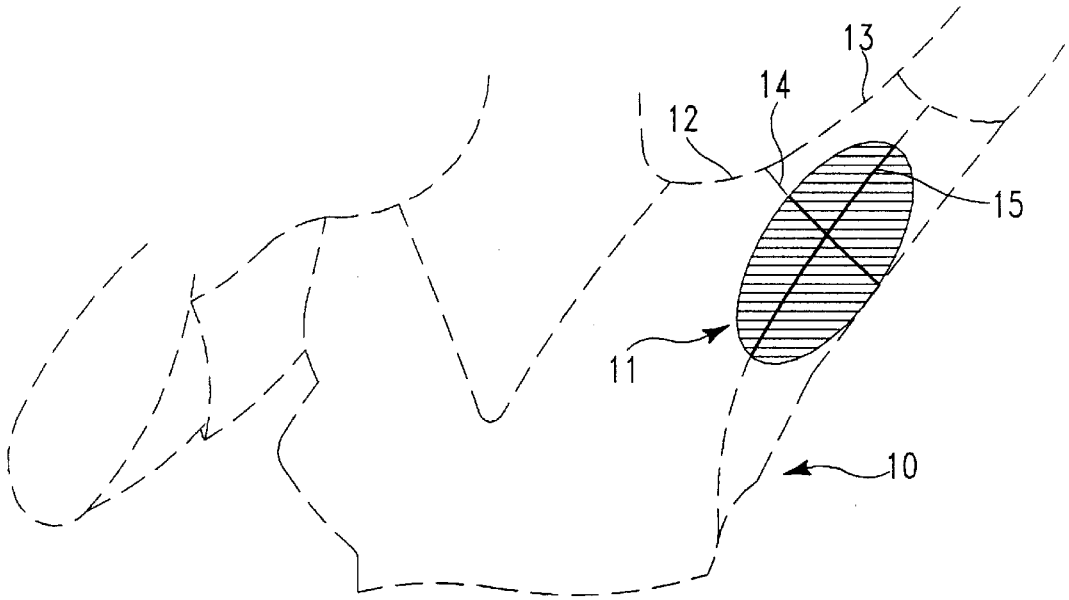
FIG. 1 is a front perspective view of a woman's garment, partly broken away.

31—bottom portion of the pocket assembly;

Referring now to FIG. 1, there is shown a woman's garment 10 cut away at the armpit to show a pocket assembly 11 of a fabric such as cotton.

Figure 2:
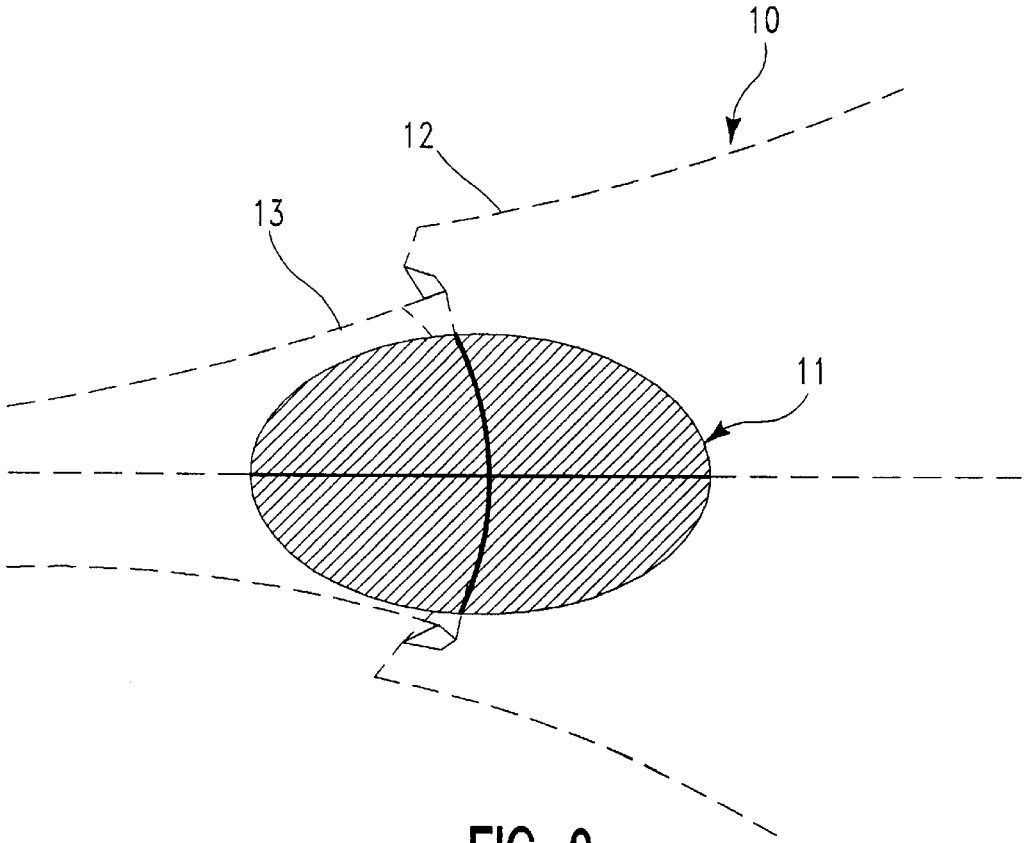
FIG. 2 is a cut away plan view of the underarm interior surface of the woman's garment of FIG. 1, with the pocket assembly in place.

As best seen in FIGS. 1 and 2, the garment 10 is shown on its interior as having a main body 12, a sleeve 13, a stitched seam 14 where the sleeve is connected to the body and a vertical stitched seam 15 that runs the length of the sleeve 13 and down the side of the body 12 of the garment 10. A pocket assembly 11 is shown connected to the garment 10, by stitching to the existing seams 14, 15 of the garment 10.

Figure 3:
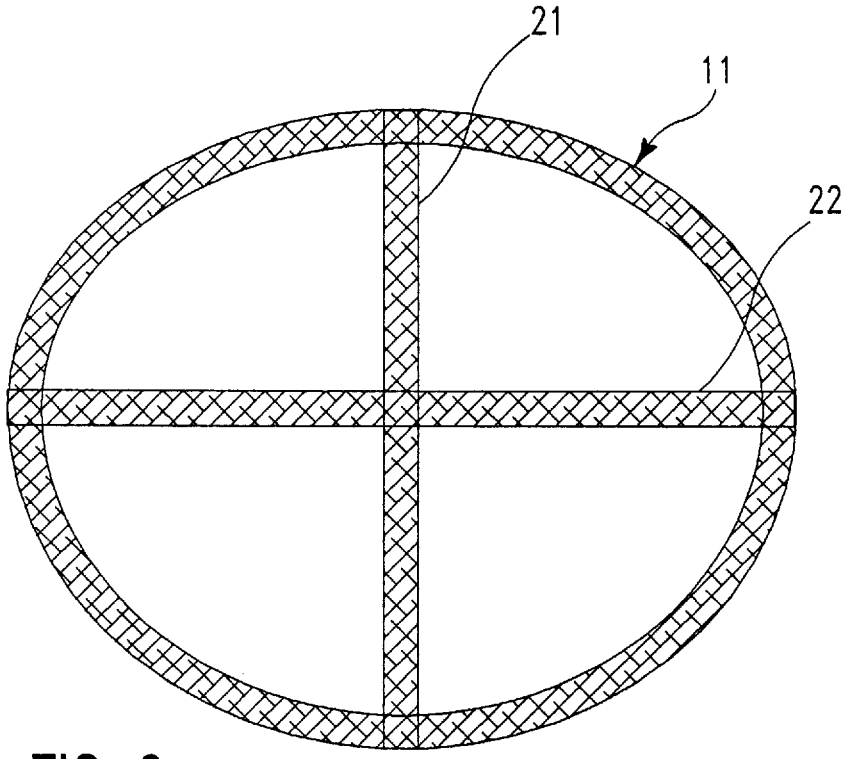
FIG. 3 is a bottom view of the pocket assembly.

As shown in FIG. 3, the bottom of the pocket assembly is shown as comprising four quadrants seamed at 21 and 22. The seam lines 21, 22 of the bottom of the pocket are connected to the existing seam lines 14, 15 of the garment 10. The pocket assembly 11 is thus seen to be attachable to a completed garment 10.

Figure 4:
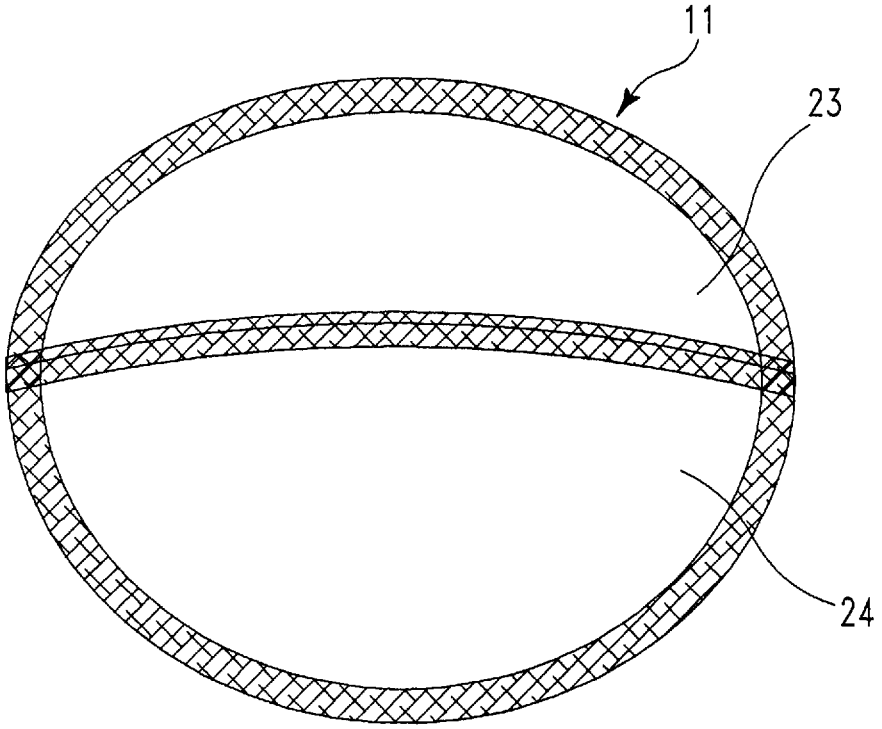
FIG. 4 is a top view of the pocket assembly.

FIG. 4 illustrates the top of the pocket assembly 11 as including a first piece 23 of the fabric cut the same shape and length of the bottom section and extending from one side a little more than one half of the width of the bottom section. A second piece 24 or top flap of fabric is cut to the same length of the bottom section and extends from the opposite side a little more than one half the width of the bottom and overlaps the first piece 23.

The first 23 and second 24 pieces form an opening through which an antiperspirant absorbent shield or pad, or any item the wearer wishes to have contained within the garment, can be inserted.

The shape and size of the pocket assembly can be changed depending on the size of the existing garment, the area within the garment, where it will be attached and the fabric being used in construction of the pocket assembly. The pocket assembly could be a kite shape for mens' garments, oval shape for womens', as well as rectangular, square or circular.

With this assembly 11 the stitching lines can not be seen on the outside of the garment which would ruin the outer appearance of the garment. The pocket assembly 11 is also removable without destroying the garment.

While the pocket assembly 11 is shown in the FIGS. as attached to the underarm area of a garment, it can, in fact, be attached to any area of the garment depending on the needs of the wearer, e.g. padding in a bra. Additionally, it can be used in garments for both males and females.

The pocket assembly may be of an elastic material to hold an inserted anti-perspirant shield therein. Also the assembly may have double flaps as illustrated or a single flap with a small opening.

Regardless of the shape of the pocket assembly or the arrangement of the flap closure, the seams of the assembly are always stitched to the seam lines of the garment.

It should be obvious that changes, additions and omissions may be made in the details and arrangement of parts without departing from the scope of the invention as defined in the appended claims.

I claim:

1. A combination garment and pocket assembly comprising:

a garment sleeve portion (18), a garment body portion (10) and a pocket assembly (11) connected to the garment;

said sleeve portion is connected to said body portion by a first stitched seam (14); said sleeve includes a vertical second seam (20) which extends the length of the sleeve; the body portion (11) includes a third seam (19) joining front and back panels (16 and 17) of the garment (10) and extending a length of the garment; an end of the third seam (19) is coincident and meets with an end of the second seam (20) to form one continuous forth seam (15);

a bottom (31) of said pocket assembly includes four quadrants joined by perpendicular fifth and six crossing seams (21 and 22) forming a bottom of the pocket assembly; the fifth and sixth seams are coincident and joined to the first and fourth seams (14 and 15); the bottom of the pocket assembly is that of an oval configuration; said seams (21 and 22) of said pocket assembly cannot be seen on the outside of the garment and hence not interfering with the outer appearance of the garment because the seam lines (21 and 22) of the pocket assembly are stitched to the seam lines (14 and 15) of the garment; and a top of the pocket assembly includes a first top piece and a second top piece (23 and 24) of cut fabric; both pieces are of the same length as the bottom (31) of said pocket assembly and are of the same configuration as half of the bottom (31); a width of each top piece is greater than one half a width of the bottom piece; wherein both top pieces when joined are in of same configuration as the bottom (31); said first and second top pieces are joined to the bottom piece and to each other in a manner which causes the two top pieces to overlap; the first and second top pieces are also joined in such a manner to form an opening through which a deodorized absorbent shield is inserted.

* * * * *